US010678163B2

(12) United States Patent
Tanaka

(10) Patent No.: US 10,678,163 B2
(45) Date of Patent: Jun. 9, 2020

(54) POWDER PASSAGE COMPONENT AND POWDER PROCESSING APPARATUS USING POWDER PASSAGE COMPONENT

(71) Applicant: FUJI XEROX CO., LTD., Tokyo (JP)

(72) Inventor: Yoshinori Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/292,346

(22) Filed: Mar. 5, 2019

(65) Prior Publication Data

US 2020/0096902 A1 Mar. 26, 2020

(30) Foreign Application Priority Data

Sep. 26, 2018 (JP) ..... 2018-180662

(51) Int. Cl.
*G03G 15/08* (2006.01)

(52) U.S. Cl.
CPC ..... *G03G 15/0865* (2013.01); *G03G 15/0881* (2013.01); *G03G 2215/08* (2013.01)

(58) Field of Classification Search
CPC ..... G03G 15/0865; G03G 15/0881; G03G 2215/08
See application file for complete search history.

(56) References Cited

U.S. PATENT DOCUMENTS 5,282,003 A * 1/1994 Michlin ..... G03G 15/0894 141/363

6,137,972 A * 10/2000 Playfair ..... G03G 15/0872 141/363

(Continued)

FOREIGN PATENT DOCUMENTS

JP 2016-130792 7/2016

*Primary Examiner* — Francis C Gray
(74) *Attorney, Agent, or Firm* — JCIPRNET

(57) ABSTRACT

A powder passage component includes a first passage defining unit, a second passage defining unit, and a sealing section. The first passage defining unit has at least a first connecting opening which is formed at a part thereof and which has a first peripheral edge. The first passage defining unit defines a passage space which allows powder to pass therethrough. The second passage defining unit has a second connecting opening having a second peripheral edge, is connected to the first connecting opening of the first passage defining unit at the second connecting opening, and defines a passage space which allows the powder to pass therethrough. The sealing section seals the first peripheral edge and the second peripheral edge. The sealing section includes a liquid gasket. The sealing section has a groove that has a bottom portion and a side facing the corresponding passage space. The groove is formed along one of the first peripheral edge and the second peripheral edge. The liquid gasket is applied to an inside of the groove and elastically deformed so as to be brought into contact with another of the first peripheral edge and the second peripheral edge facing the groove. The sealing section has at least one escape groove that is provided at the bottom portion of the groove or along the other of the first peripheral edge and the second peripheral edge facing the groove. The at least one escape groove allows a part of an elastically deformed portion of the liquid gasket to escape so as not to allow the liquid gasket to extend past at least the side of the groove facing the corresponding passage space.

10 Claims, 10 Drawing Sheets

(56) References Cited

U.S. PATENT DOCUMENTS

| | | | | |
|---|---|---|---|---|
| 2005/0249518 | A1* | 11/2005 | Huang | G03G 15/0874 399/106 |
| 2006/0228134 | A1* | 10/2006 | Ishiguro | G03G 15/0879 399/258 |
| 2013/0322927 | A1* | 12/2013 | Matsumoto | G03G 15/0879 399/258 |
| 2017/0102640 | A1* | 4/2017 | Sato | G03G 15/0865 |
| 2017/0153575 | A1* | 6/2017 | Schulkes | G03G 15/0867 |
| 2017/0153576 | A1* | 6/2017 | Fujimura | G03G 15/0877 |

* cited by examiner

POWDER PASSAGE COMPONENT AND POWDER PROCESSING APPARATUS USING POWDER PASSAGE COMPONENT

CROSS-REFERENCE TO RELATED APPLICATIONS

This application is based on and claims priority under 35 USC 119 from Japanese Patent Application No. 2018-180662 filed Sep. 26, 2018.

BACKGROUND

(i) Technical Field

The present disclosure relates to a powder passage component and a powder processing apparatus using the powder passage component.

(ii) Related Art

In the related art, as such a powder processing apparatus, for example, a developing device described in Japanese Unexamined Patent Application Publication No. 2016-130792 is known.

Japanese Unexamined Patent Application Publication No. 2016-130792 (Detailed Description, FIGS. 5A and 5B) discloses the developing device that is to suppress leakage of toner to the outside of a side seal includes a housing, a developing roller, and the side seal. The housing has a developing chamber containing the toner. The developing roller is rotatably provided in the housing. The side seal is provided between the housing and a lateral end portion and includes a base material and a mesh-shaped contact member provided on the base material and in contact with the developing roller. The base material has a first path and a second path that connect the contact member and the developing chamber to each other.

SUMMARY

Aspects of non-limiting embodiments of the present disclosure relate to suppression of spilling of a liquid gasket applied to a groove formed along a peripheral edge of a connecting opening to a powder passage when a connecting portion of the powder passage is sealed with the liquid gasket.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a powder passage component including a first passage defining unit, a second passage defining unit, and a sealing section. The first passage defining unit has at least a first connecting opening which is formed at a part thereof and which has a first peripheral edge. The first passage defining unit defines a passage space which allows powder to pass therethrough. The second passage defining unit has a second connecting opening having a second peripheral edge, is connected to the first connecting opening of the first passage defining unit at the second connecting opening, and defines a passage space which allows the powder to pass therethrough. The sealing section seals the first peripheral edge and the second peripheral edge. The sealing section includes a liquid gasket. The sealing section has a groove that has a bottom portion and a side facing the corresponding passage space. The groove is formed along one of the first peripheral edge and the second peripheral edge. The liquid gasket is applied to an inside of the groove and elastically deformed so as to be brought into contact with another of the first peripheral edge and the second peripheral edge facing the groove. The sealing section has at least one escape groove that is provided at the bottom portion of the groove or along the other of the first peripheral edge and the second peripheral edge facing the groove. The at least one escape groove allows a part of an elastically deformed portion of the liquid gasket to escape so as not to allow the liquid gasket to extend past at least the side of the groove facing the corresponding passage space.

BRIEF DESCRIPTION OF THE DRAWINGS

Exemplary embodiment of the present disclosure will be described in detail based on the following figures, wherein.

DETAILED DESCRIPTION

Outline of Exemplary Embodiment

A powder processing apparatus typically includes a powder passage component having a passage space that allows powder to pass therethrough. The powder processing apparatus performs processing with the powder passing through the powder passage component.

According to this exemplary embodiment, the powder passage component of the powder processing apparatus is particularly technically characterized.

Figure 1A:
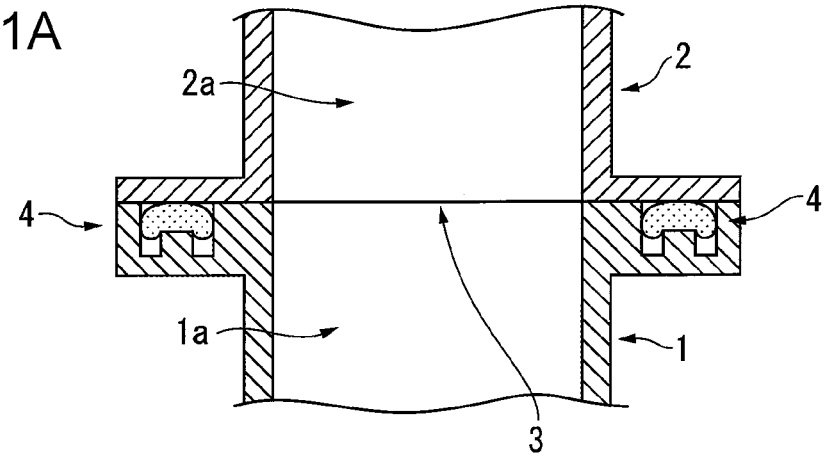
FIG. 1A illustrates an outline of an exemplary embodiment of a powder passage component to which the present disclosure is applied.
Figure 1B:
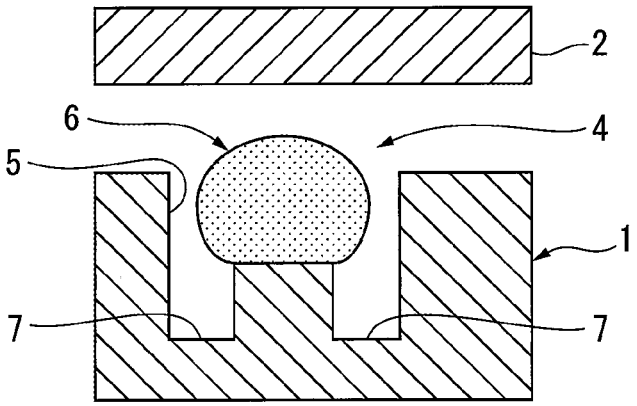
FIG. 1B illustrates a state of a connecting portion of a powder passage before the connecting portion is sealed with a liquid gasket.
Figure 1C:
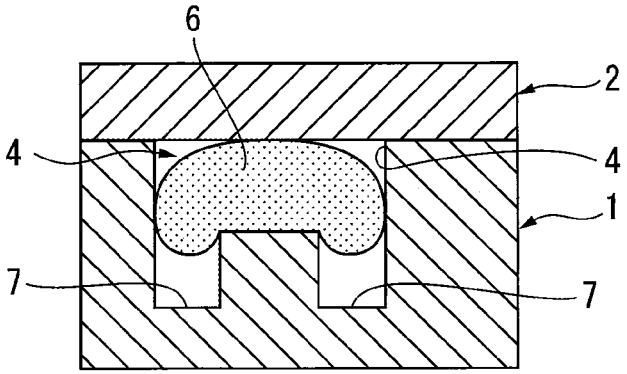
FIG. 1C illustrates a state of the connecting portion sealed with the liquid gasket.

That is, in this example, a powder passage component includes, as illustrated in FIG. 1A, a first passage defining unit 1, a second passage defining unit 2, and a sealing section 4. The first passage defining unit 1 has an opening at least at part thereof and defines a passage space 1*a*. The passage space 1*a* allows the powder to pass therethrough. The second passage defining unit 2 is connected to the opening of the first passage defining unit 1 and defines a passage space 2*a*. The passage space 2*a* allows the powder to pass therethrough. The sealing section 4 seals the peripheral edges of a connecting opening 3 of the first passage defining unit 1 and a connecting opening 3 of the second passage defining unit 2. As illustrated in FIGS. 1B and 1C, the sealing section 4 has, for example, a groove 5, a liquid gasket 6, and escape grooves 7. The groove 5 is formed along the peripheral edge of the connecting opening 3 of the first passage defining unit 1. The liquid gasket 6 is applied to the inside of the groove 5 and elastically deformed so as to be brought into contact with, for example, the peripheral edge of the connecting opening 3 of the second passage defining unit 2 facing the groove 5. The escape grooves 7 are provided along a bottom portion of the groove 5 and allows part of the elastically deformed portion of the liquid gasket 6 to escape so as not to allow the liquid gasket 6 to extend past at least the side of the groove 5 facing the corresponding passage space.

Referring to FIGS. 1A to 1C, the groove 5 is formed in the first passage defining unit 1. However, the groove 5 may be formed along the peripheral edge of the connecting opening 3 of the second passage defining unit 2. In this case, the liquid gasket 6 is applied to the inside of this groove 5 and elastically deformed so as to be brought into contact with the peripheral edge of the connecting opening 3 of the first passage defining unit 1. Furthermore, although the escape grooves 7 are provided at the bottom portion of the groove 5 in FIGS. 1A to 1C, this is not limiting. The escape grooves 7 may be provided along the peripheral edge of the connecting opening 3 of the passage defining unit (passage defining unit 2 in this example) facing the groove 5.

In the technical device as described above, the technique described herein is applied to a powder passage component that allows powder (for example, developer such as toner) to pass through the powder passage component.

Here, the powder passage component is not limited to a component that contains the powder. The powder passage component may be any of components such as components that transport the powder.

Furthermore, the structure of the powder passage component may be appropriately selected as long as the first passage defining unit 1 (having the opening) and the second passage defining unit 2 are connected to each other and the peripheral edges of the connecting openings 3 thereof are sealed with the sealing section 4.

Furthermore, a form in which the groove 5 is provided in one of the first and second passage defining units 1, 2 may be appropriate. Here, a form in which the groove 5 is provided in each of the first and second passage defining units 1, 2 may be thought. However, considering a possibility of damaging a sealing action realized by the liquid gasket 6, a form in which the groove 5 is provided in one of the first and second passage defining units 1, 2 may be selected.

Furthermore, it is assumed that the liquid gasket (corresponding to a liquid sealing member) 6 is typically of a non-foaming type. The reason for this is that, with a foaming liquid gasket, which is reliably provided with a large amount of elastic deformation due to existence of bubbles therein, technical problems similarly to or the same as the present application do not arise.

Furthermore, the escape grooves 7 are not necessarily provided in the bottom portion of the groove 5. As described above, the escape grooves 7 may be provided in the passage defining unit facing the groove 5.

Here, the reason for providing the escape grooves 7 are "not to allow the liquid gasket 6 to extend past at least the side of the groove 5 facing the corresponding passage space". This is based on a possibility of altering the quality of the powder due to generation of agglomerate of the powder when an oil component included in the liquid gasket 6 is brought into contact with the powder (such as toner). Thus, the present application includes the case where spilling of the liquid gasket 6 from the groove 5 in a portion not facing the powder passage is present.

Furthermore, the escape grooves 7 may have a substantially rectangular shape in section from the viewpoint of reliably allocating a space. However, it is not limiting and the escape grooves 7 may have any sectional shape.

Furthermore, it is required that the escape grooves 7 be provided at the bottom portion of the groove 5 or along the peripheral edge of the passage defining unit facing the groove 5. Although it is appropriate that the "peripheral edge" here is the entirety of the peripheral edge, a form in which the escape grooves 7 are formed along part of the peripheral edge is included. That is, in a form in which, for example, the connecting opening 3 has corner portions and the dimension of the groove 5 in the width direction is larger in portions corresponding to the corner portions than portions not corresponding to the corner portions, it is possible to contain the liquid gasket 6 without spilling of the liquid gasket 6 from portions of the groove 5 located at the corner portions even when the escape grooves 7 are not provided at positions of the groove 5 corresponding to the corner portions. Thus, the form in which the escape grooves 7 are discontinuous at part of the peripheral edge is included.

Next, representative forms or appropriate forms of the powder passage component according to the present exemplary embodiment are described.

First, as a representative form of the groove 5, there exists a form in which the depth of the groove 5 to the bottom portion other than the escape grooves 7 is smaller than a lower limit value within a height tolerance for an application amount of the liquid gasket 6. This example is a required structural example for the depth of the groove 5 other than the escape grooves 7 in maintaining sealing performance of the liquid gasket 6 even when the application amount of the liquid gasket 6 to the groove 5 varies.

Furthermore, as another representative form of the groove 5, there exists a form in which the sectional area in the width direction intersecting the direction in which the groove 5 and the escape grooves 7 extend is smaller than or equal to an upper limit value within a sectional area tolerance for the application amount of the liquid gasket 6. This example is a required structural example for the sectional area of the groove 5 including the escape grooves 7 in the width direction in suppressing spilling of the liquid gasket 6 from the groove 5 even when the application amount of the liquid gasket 6 to the groove 5 varies.

Furthermore, as an appropriate form of the escape grooves 7, there exists a form in which the escape grooves 7 are deeply recessed grooves forming, together with the bottom portion of the groove 5, a stepped shape. This example is a structural example in which the escape grooves 7 are deeply recessed at the bottom portion of the groove 5. In this example, the liquid gasket 6 enters the escape grooves 7 deeply recessed in the groove 5 after sealing. Thus, even when one of the passage defining units (passage defining unit 2 in FIGS. 1A to 1C) is reopened, the liquid gasket 6 remains attracted to the groove 5 of the other passage defining unit (passage defining unit 1 in FIGS. 1A to 1C) and is held. In a form where the reopening is not intended, the escape grooves 7 may be provided in the passage defining unit facing the groove 5 (passage defining unit 2 in this example).

Furthermore, as a representative example of the escape grooves 7, there exists a form in which a single escape groove 7 is formed at least in a portion facing the passage space 1*a*, 2*a* in the width direction intersecting the direction in which the groove 5 extends. In this example, the liquid gasket 6 applied to the groove 5 escapes into the escape groove 7 near the passage space 1*a*, 2*a* after sealing. Thus, the likelihood of spilling of the liquid gasket 6 toward the passage space may be suppressed.

Here, as another appropriate form of the escape grooves 7, there exists a form in which the escape grooves 7 are formed in both portions in the width direction intersecting the direction in which the groove 5 extends. In this example, the escape grooves 7 are formed in both portions of the groove 5 in the width direction, thereby allowing the liquid gasket 6 to escape into the escape grooves 7 so that spilling of the liquid gasket 6 from a region around the groove 5 after sealing may be suppressed.

As yet another appropriate form of the escape grooves 7, there exists a form in which, in portions of the corresponding connecting opening 3 along linear portions other than corner portions, the escape grooves 7 are formed in both portions in the width direction intersecting the direction in which the groove 5 extends, and in portions corresponding to the corner portions, only one of the escape grooves 7 in an inner portion in the width direction is formed. In this example, the escape groove 7 may be provided in the inner portion in the width direction in regions near the corner portions of the corresponding connecting opening 3. The reason for this is that the sectional area of the groove 5 in an outer portion in the width direction may be reliably increased without the other escape groove 7 at portions corresponding to the corner portions of the connecting opening 3.

Furthermore, although it is sufficient that the groove 5 is formed along the peripheral edge of the connecting opening 3, an extension groove may be additionally provided at part of the groove 5. For example, there exists a form in which the groove 5 is formed along the peripheral edge of the connecting opening 3, an extension groove (not illustrated in FIGS. 1A to 1C) outwardly extending from the groove 5 is added to a portion of the groove 5 corresponding to one of the corner portions of the connecting opening 3, and the extension groove is used as a start point and an end point for applying the liquid gasket 6. This example is in the form that may ensure a work space for an application start point and an application end point when applying the liquid gasket 6.

Further details of the present disclosure will be described below based on an exemplary embodiment illustrated in the attached drawings.

First Exemplary Embodiment

Figure 2:
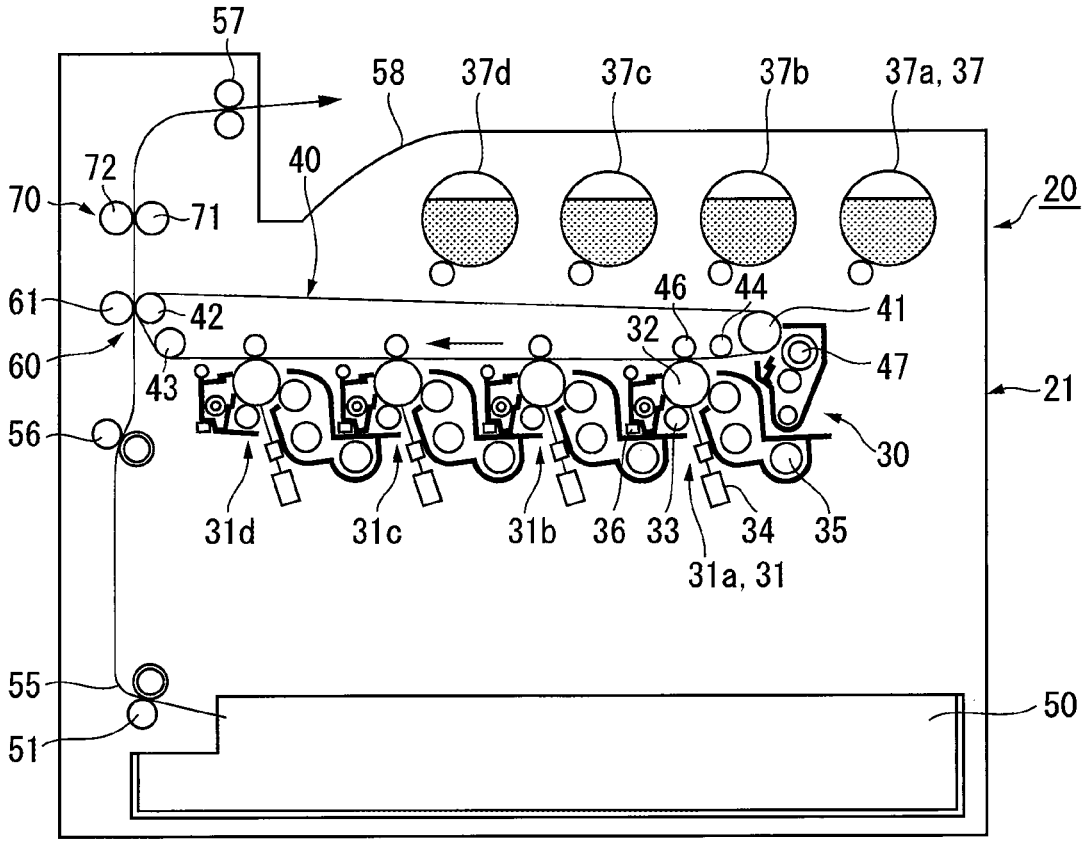
FIG. 2 illustrates an overall structure of an image forming apparatus serving as a powder processing apparatus according to a first exemplary embodiment.

FIG. 2 illustrates an overall structure of an image forming apparatus serving as a powder processing apparatus according to a first exemplary embodiment.

Overall Structure of the Image Forming Apparatus

Referring to FIG. 2, in an image forming apparatus 20, devices and so forth are disposed as follows: an image forming engine 30 able to form images of color components is mounted in an image forming apparatus body 21; a sheet feed device 50 that supplies sheets of paper S serving as recording media is provided below the image forming engine 30 in the image forming apparatus body 21; a transport path 55 through which each of the sheets S supplied from the sheet feed device 50 is transported in the substantially vertical direction is formed along one side surface (in this example, corresponding to the left side in FIG. 2) of the image forming apparatus body 21; a transfer device 60 that transfers the images formed by the image forming engine 30 onto the sheet S is provided in a portion of the transport path 55 facing the image forming engine 30; and a fixing device 70 that fixes the images having been transferred onto the sheet S is provided downstream of the transfer device 60 in the transport direction of the sheet S in the transport path 55.

The Image Forming Engine

According to the first exemplary embodiment, the image forming engine 30 includes a plurality of image forming units 31 (specifically, 31*a* to 31*d*) and an intermediate transfer body 40. The image forming units 31 form images of a plurality of color components (in this example, four colors, that is, yellow Y, magenta M, cyan C, and black K) by using, for example, an electrophotographic system. The intermediate transfer body 40 has, for example, a belt shape. The images of the color components formed by the image forming units 31 are temporarily transferred to the intermediate transfer body 40, and the intermediate transfer body 40 temporarily holds the transferred images before the images are transferred onto the sheet S.

In this example, the image forming units 31 (31*a* to 31*d*) each include a photosensitive body 32, a charger 33, an image drawing device 34, a developing device 35, and a cleaner 36. The charger 33 (in this example, a charging roller is used) charges the photosensitive body 32. The image drawing device 34 (in this example, an LED drawing head is used) draws an electrostatic latent image on the charged photosensitive body 32. The developing device 35 develops with toner the electrostatic latent image formed on the photosensitive body 32. The cleaner 36 cleans the photosensitive body 32 by removing matter such as toner remaining on the photosensitive body 32.

Furthermore, in this example, the intermediate transfer body 40 is looped over a plurality of (four in this example) stretching rollers 41 to 44. The intermediate transfer body 40 is circularly rotated in an arrow direction illustrated in FIG. 2 by, for example, the stretching roller 41 serving as a drive roller out of the stretching rollers 41 to 44.

In this example, the image forming units 31 are arranged in the substantially parallel direction following the rotating direction of the intermediate transfer body 40 below the intermediate transfer body 40. A first transfer device 46 (a transfer roller is used in this example) is provided on the rear surface side of the intermediate transfer body 40 facing the photosensitive body 32 of each of the image forming units 31. Thus, the images of the color components formed on the photosensitive bodies 32 are sequentially electrostatically transferred onto the intermediate transfer body 40.

In this example, a transfer device (in this example, corresponding to a second transfer device transferring the images from the intermediate transfer body 40 to the sheet S through second transfer) 60 is provided in a portion facing the stretching roller 42 for the intermediate transfer body 40. Furthermore, an intermediate transfer body cleaner 47 that cleans the intermediate transfer body 40 by removing matter such as toner or paper dust remaining on the intermediate transfer body 40 is provided in a portion facing the stretching roller 41. Furthermore, the stretching roller 43 is also used as a tension adjusting roller that adjusts the tension of the intermediate transfer body 40.

The Transfer Device (Second Transfer Device)

According to the present exemplary embodiment, the second transfer device 60 is basically structured as follows: a transfer roller 61 is provided so as to face the stretching roller 42 of the intermediate transfer body 40; for example, the transfer roller 61 is grounded, and a transfer voltage is applied to the stretching roller 42 from a transfer power source (not illustrated); and a transfer electric field is formed in a transfer region between the intermediate transfer body 40 and the transfer roller 61. Thus, the images on the intermediate transfer body 40 are transferred through second transfer onto the sheet S passing through the transfer region.

The Fixing Device

According to the present exemplary embodiment, the fixing device 70 includes a heating fixing member (in this example, a heating fixing roller is used) 71 and a pressure fixing member (in this example, a pressure fixing roller is used) 72. The heating fixing member 71 is rotatable. The surface of the heating fixing member 71 is heated to a predetermined temperature by a heater serving as a heat source. The pressure fixing member 72 is in contact with the heating fixing member 71 in the axial direction of the heating fixing member 71 at a predetermined pressure so as to be rotated. The sheet S holding the unfixed images is caused to pass through a contact portion between both the fixing members 71, 72, thereby the unfixed images are fixed.

Sheet Transport System

According to the present exemplary embodiment, a sheet transport system operates as follows: the sheet S is fed from a feeding device 51 of the sheet feed device 50 to the transport path 55; the position of the sheet S is adjusted by a position adjustment roller 56, which is provided upstream of a second transfer region of the second transfer device 60 in the transport direction of the sheet S in the transport path 55, and then, a transfer process is performed by the second transfer device 60; and furthermore, the sheet S having undergone a fixing process performed by the fixing device 70 is output by an output roller 57 toward a sheet receiving portion 58 formed at the top of the image forming apparatus body 21. Of course, an appropriate number of transport members (such as transport rollers) may be provided in the transport path 55 according to need. Duplex printing may be performed as follows: a duplex transport unit (not illustrated) is added; the sheet S on one side of which the images have been recorded is inverted and returned through a duplex transport path (not illustrated) to a position upstream of the position adjustment roller 56 in the sheet S transport direction in the transport path 55; and the image forming process is performed on the other side of the sheet S than the side on which the images have already been formed.

Developer Supply Device

Figure 3A:
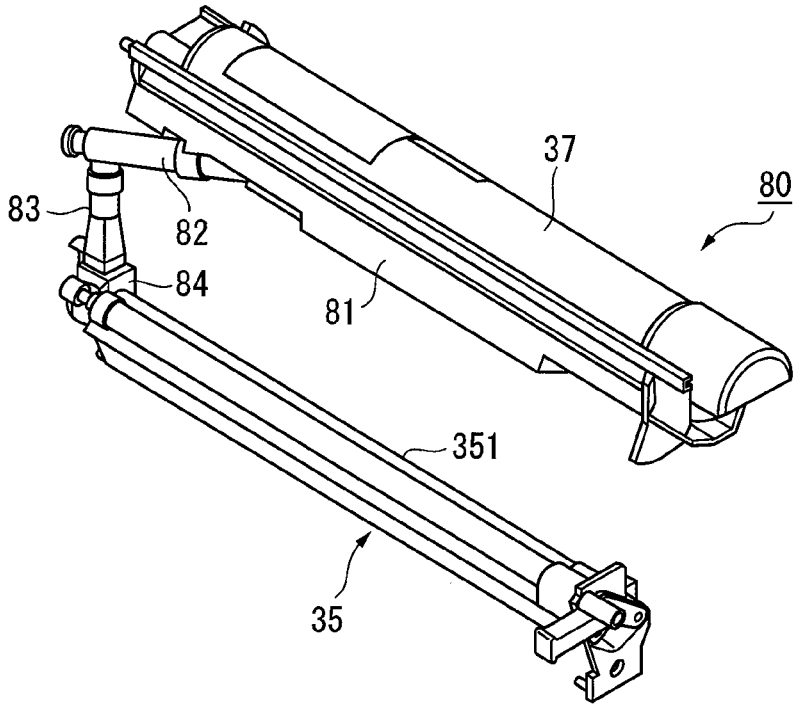
FIG. 3A illustrates a developer supply device that is used for the image forming apparatus according to the first exemplary embodiment and supplies developer serving as powder to a developing device.
Figure 3B:
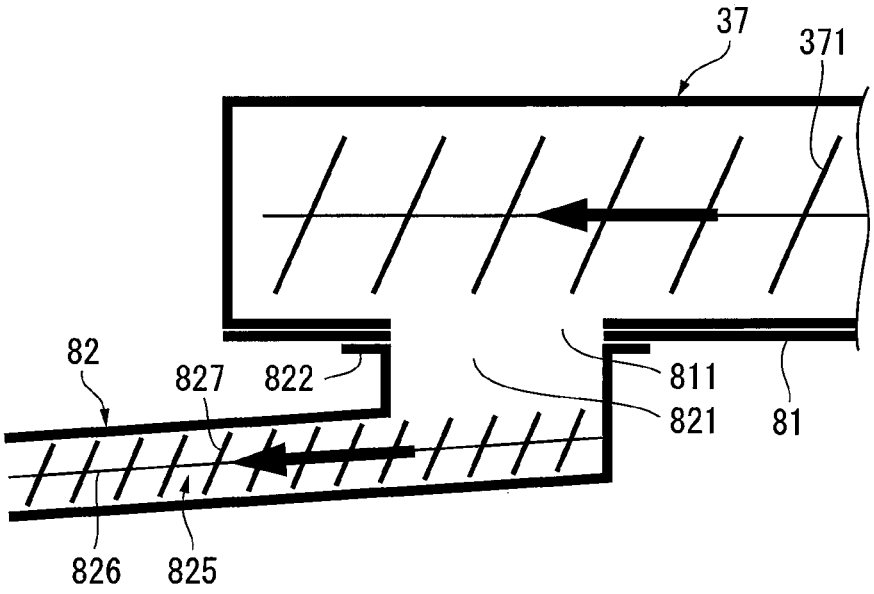
FIG. 3B illustrates an example of the structure of the connecting portion where a toner cartridge of the developer supply device containing toner serving as the developer and a dispensing pipe through which the toner supplied from the toner cartridge is transported are connected to each other.

According to the present exemplary embodiment, as illustrated in FIGS. 2, 3A, and 3B, in the image forming apparatus body 21, a developer supply device 80 is provided. The developer supply device 80 supplies developer (in this example, toner) of the color components (yellows Y, magenta M, cyan C, and black K) to the developing devices 35 of the image forming units 31 (31*a* to 31*d*).

In this example, the developer supply device 80 includes toner cartridges 37 (37*a* to 37*d*) containing the toner of the color components. Each of the toner cartridges 37 includes a toner transport member 371 therein. Replenishment with the toner is performed by opening a shutter 372 (omitted from FIG. 3B; see FIG. 4) opening that is able to be opened/closed. In the developer supply device 80, each of the toner cartridges 37 is held by a corresponding one of cartridge receiving portions 81, a substantially rectangular supply opening 811 (corresponding to the connecting opening) is formed in part of the cartridge receiving portion 81 so as to allow the toner (developer) from the shutter 372 opening of the toner cartridge 37 to fall therethrough, a dispensing pipe 82 for metering the toner is provided below the supply opening 811 so as to intersect the supply opening 811, a vertical pipe 83 that extends in the vertical direction is provided near the exit of the dispensing pipe 82 so as to extend downward, and a connecting portion 84 for connection with the developing device 35 is provided near a lower end of the vertical pipe 83.

Here, as illustrated in FIG. 3B, a metering transport member 825 having a helical blade 827 on a rotation shaft 826 thereof is provided in the dispensing pipe 82. Furthermore, an agitator (not illustrated) is provided in the vertical pipe 83. The agitator is formed by a helical metal coil.

A connection target portion (not illustrated) is connected to the connecting portion 84 of the developer supply device 80. The connection target portion is provided in a rear portion of the developing container 351 of the developing device 35 in the longitudinal direction. Thus, the developer (in this example, the toner) in the developer supply device 80 is supplied to the developing container 351 of the developing device 35.

Structure of a Connecting Portion of the Dispensing Pipe

Figure 4:
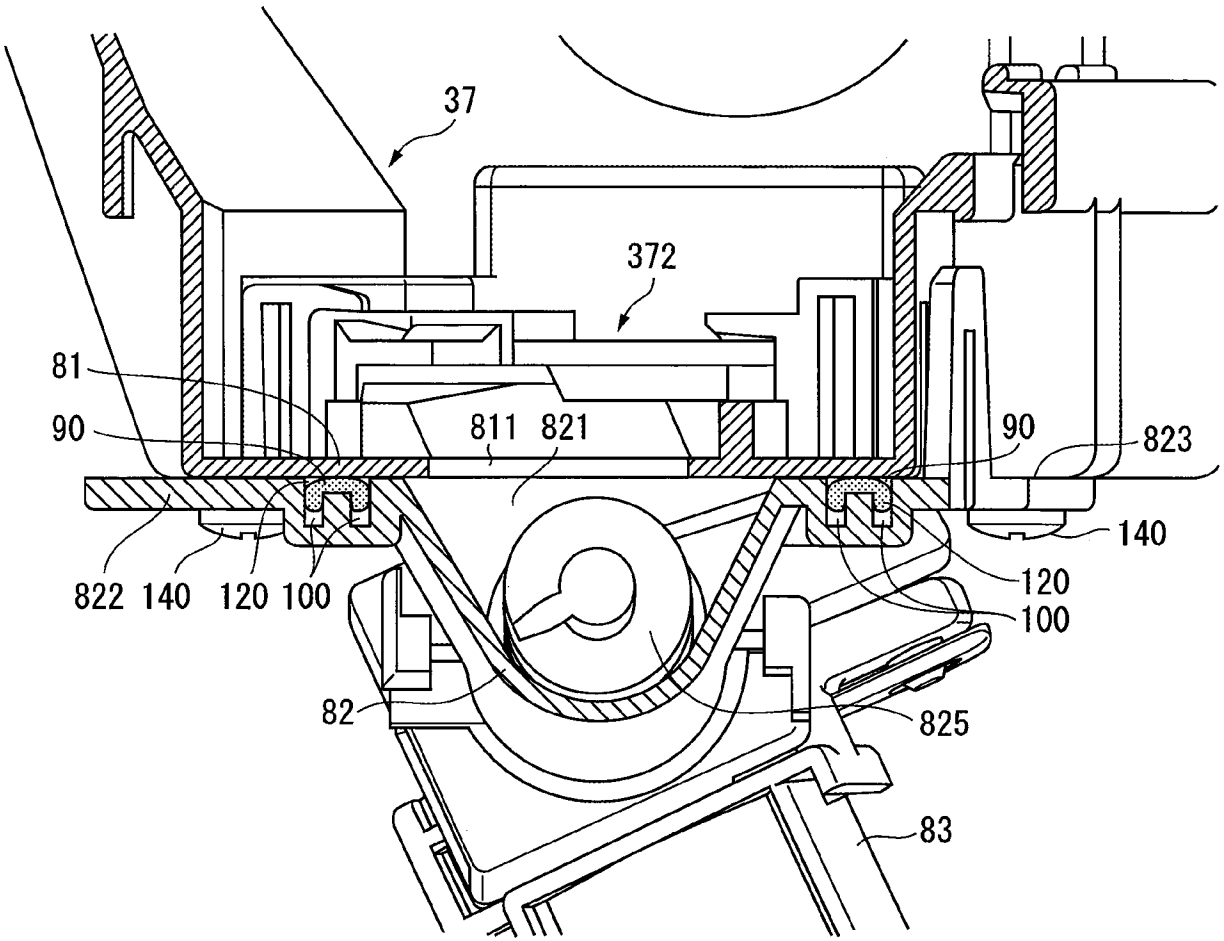
FIG. 4 illustrates the details of the connecting portion between the toner cartridge of the developer supply device and the dispensing pipe illustrated in FIG. 3B.
Figure 5:
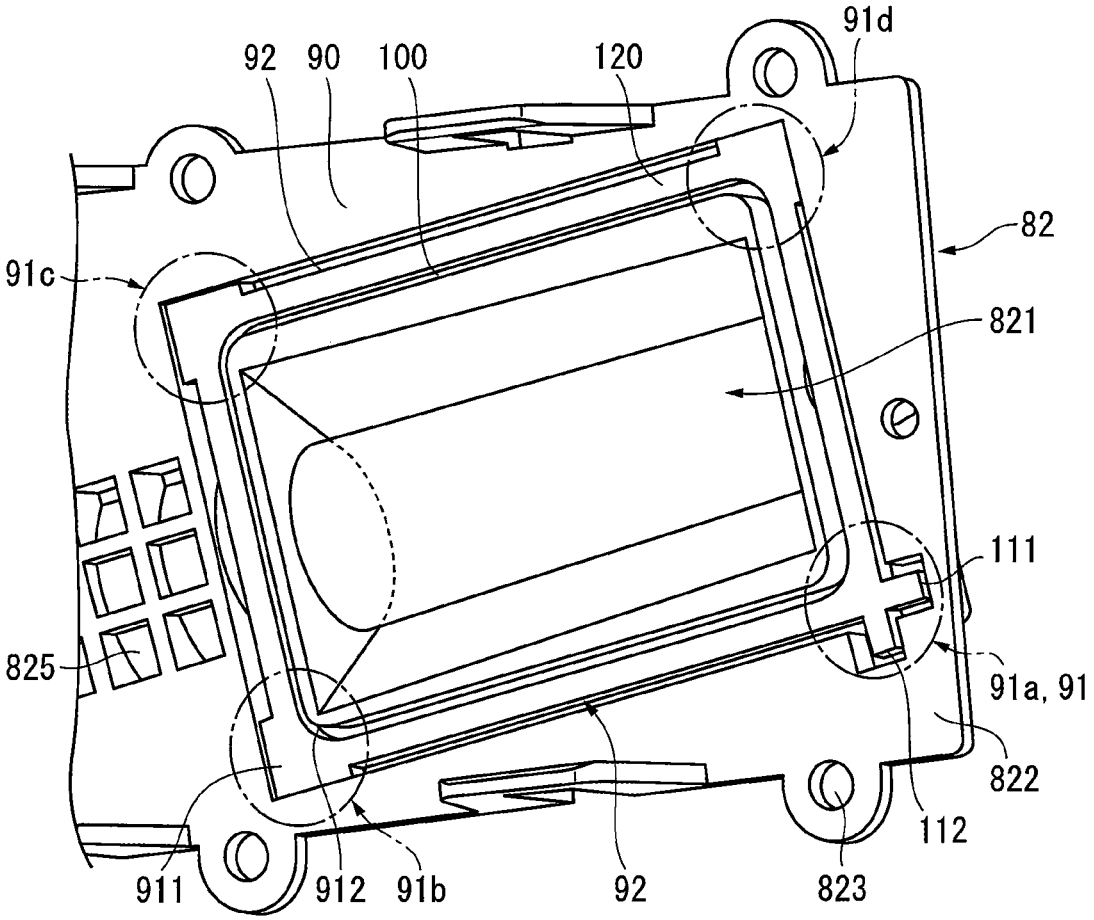
FIG. 5 illustrates the details of the connecting portion between the toner cartridge and the dispensing pipe illustrated in FIG. 4 and a region around the connecting portion with part of the connecting portion of the toner cartridge side removed.

According to the present exemplary embodiment, as illustrated in FIGS. 4 and 5, the dispensing pipe 82 is a functional member that defines the passage space through which the toner as the powder passes. The dispensing pipe 82 has a substantially rectangular connecting opening 821 facing the substantially rectangular supply opening 811 of the cartridge receiving portion 81. The dispensing pipe 82 also has a flange portion 822 around the connecting opening 821 in contact with the peripheral portion of the supply opening 811 of the cartridge receiving portion 81.

Furthermore, as described above, the cartridge receiving portion 81 is a functional member that holds the toner cartridge 37. The shutter 372 of the toner cartridge 37 is disposed in a portion of the cartridge receiving portion 81 facing the supply opening 811. The cartridge receiving portion 81 is also a functional member that communicates with the toner cartridge 37 through the supply opening 811 so as to define the passage space that allows, when the shutter 372 is open, the toner to pass through the passage space.

In this example, a sealing structure is provided in a portion where the flange portion 822 of the dispensing pipe 82 and the cartridge receiving portion 81 are connected to each other. Furthermore, an appropriate number (in this example, four) of fixing holes 823 of a retainer 140 (see FIG. 4) are provided around the flange portion 822 of the dispensing pipe 82.

The Sealing Structure

The sealing structure employed in this example has, as illustrated in FIGS. 4 and 5, a substantially rectangular groove 90 along the peripheral edge of the substantially rectangular connecting opening 821 out of the flange portion 822 of the dispensing pipe 82. In this example, the groove 90 surrounds a region around the connecting opening 821 along a rectangular locus having four corner portions 91 (specifically, 91*a* to 91*d*) and linear portions 92 connecting the corner portions 91. The groove 90 has a substantially rectangular shape in section. In this example, outer portions of all the four corner portions 91 of the groove 90 are formed as corner angle portions 911 of an angle of about 90 degrees, and inner portions of all the corner portions 91 (corresponding to a portion near the connecting opening 821 in this example) are formed as arcuate curved surface portions 912.

Furthermore, in this example, the groove 90 has escape grooves 100 substantially throughout the peripheral edge thereof. The escape grooves 100 are formed by deeply recessed grooves at the bottom portion of the groove 90, forming a stepped shape. In particular, in this example, the escape grooves 100 are differently formed between the corner portions 91 and the linear portions 92 of the groove 90.

That is, in the corner portions 91 of the groove 90, only one of the escape grooves 100 is formed at least in the inner portion in the width direction intersecting the direction in which the groove 90 extends (corresponding to a portion near the connecting opening 821).

In contrast, in the linear portions 92 of the groove 90, a pair of the escape grooves 100 are formed in both the portions in the width direction intersecting the groove 90 extending direction.

Furthermore, in this example, extension grooves 111, 112 extending outward from the groove 90 are formed at one of the four corner portions 91, for example, the corner portion 91*a* of the groove 90 in directions in which two linear portions 92 adjacent to this corner portion 91*a* extend. Although the sectional shape of the extension grooves 111, 112 may be appropriately selected, the sectional shape of the extension grooves 111, 112 is substantially the same as that of the groove 90 (except for the escape grooves 100) of the linear portions 92 in this example.

Furthermore, according to the present exemplary embodiment, as illustrated in FIG. 5, a liquid gasket 120 for sealing is applied to the inside of the groove 90.

In this example, the liquid gasket 120 used is of a non-foaming type (for example, a hot-melt adhesive).

Figure 6A:
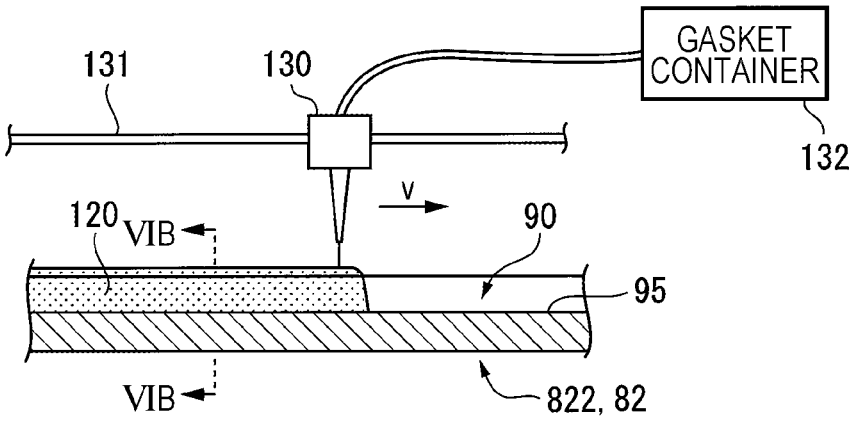
FIG. 6A illustrates an example of an application device that applies the liquid gasket to a groove around a connecting opening of the dispensing pipe illustrated in FIG. 5.
Figure 6B:
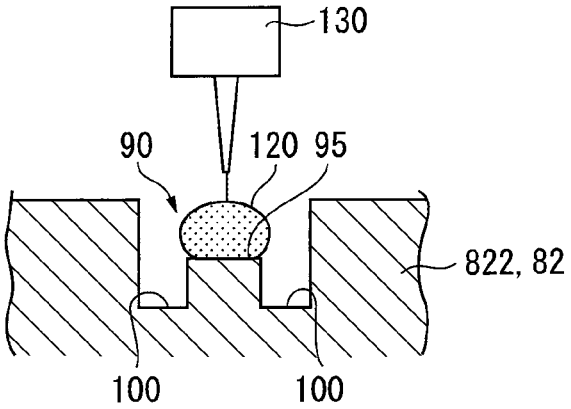
FIG. 6B is a sectional view taken along line VIB-VIB illustrated in FIG. 6A.

According to the present exemplary embodiment, as illustrated in FIGS. 6A and 6B, the liquid gasket 120 is applied with a gasket applicator 130. In this example, the liquid gasket 120 is applied with the gasket applicator 130, for example, as follows: a guide rail 131 is prepared in advance to be disposed along the locus of the groove 90 to which the liquid gasket 120 is to be applied; the gasket applicator 130 is moved at a predetermined speed v along the guide rail 131; a predetermined amount of the liquid gasket 120 contained in a gasket container 132 is applied to a bottom portion 95, as a target region, of the groove 90 other than the escape grooves 100.

Figure 6C:
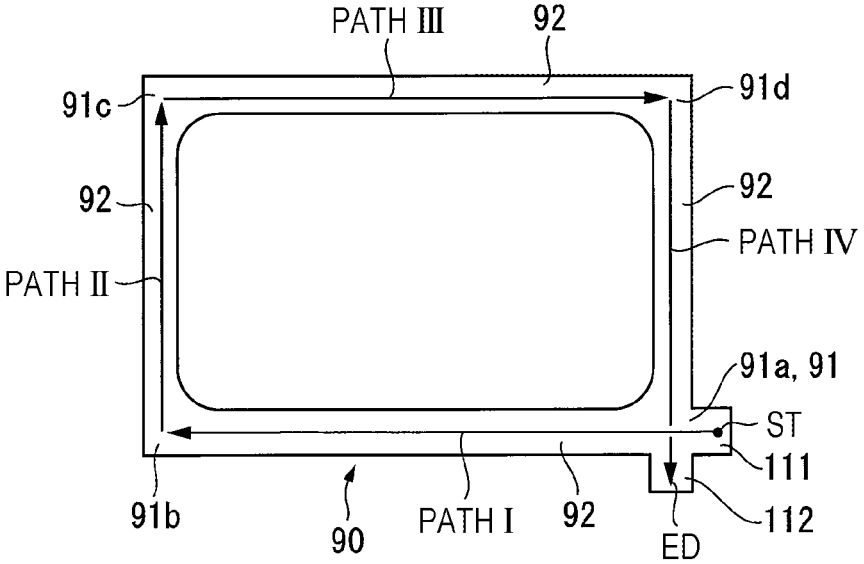
FIG. 6C illustrates an operational procedure for applying the liquid gasket to the groove around the connecting opening of the dispensing pipe.

Here, examples of movement paths of the gasket applicator 130 include, for example, paths as illustrated in FIG. 6C. These paths are described as follows: an application start point ST of the liquid gasket 120 is set at the extension groove 111 at the corner portion 91*a* of the groove 90; the gasket applicator 130 is moved from the linear portion 92 of a path I to the corner portion 91*c* through the corner portion 91*b* and the linear portion 92 of a path II; the gasket applicator 130 is further moved through the linear portion 92 of a path III to the corner portion 91*d*; the gasket applicator 130 is finally returned to the corner portion 91*a* through the linear portion 92 of a path IV and then to the extension groove 112 as an application end point ED.

Sealing Performance at the Connecting Portion of the Dispensing Pipe

Next, sealing performance at the connecting portion of the dispensing pipe is verified.

The cartridge receiving portion 81 may be fastened with the retainer 140 to the flange portion 822 of the dispensing pipe 82 as illustrated in FIGS. 4, 5, 7A, and 7B after the liquid gasket 120 has been applied to the groove 90 of the flange portion 822 of the dispensing pipe 82 as illustrated in FIGS. 6A to 6C.

Figure 7A:
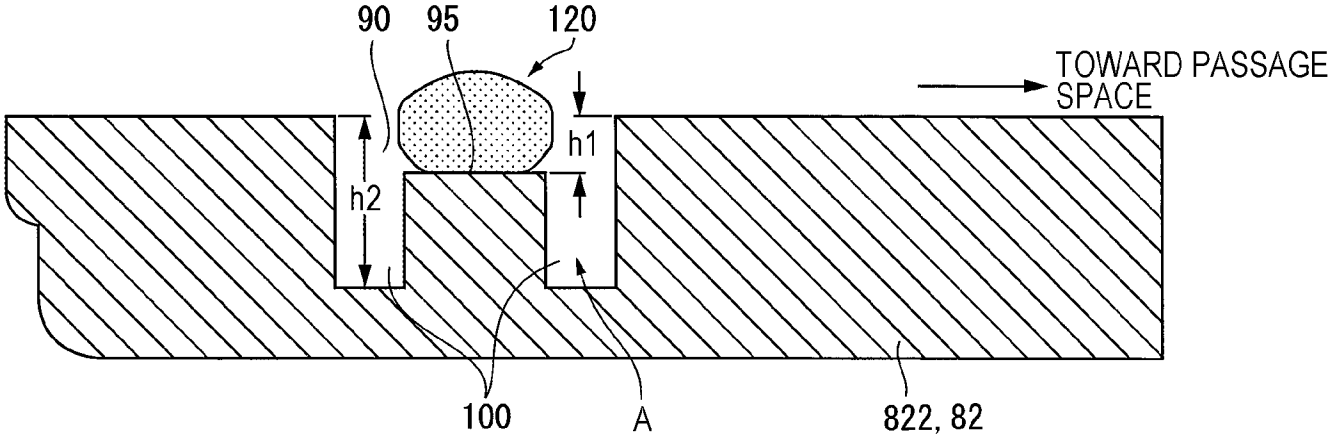
FIG. 7A schematically illustrates a state of the liquid gasket having been applied to the groove around the connecting opening of the dispensing pipe and before sealing in the developer supply device according to the first exemplary embodiment, and FIG. 7B schematically illustrates a state of the liquid gasket after sealing.

At this time, the liquid gasket 120 may be applied in such an amount that, as illustrated in FIG. 7A, a depth h1 of the groove 90 to the bottom portion 95 other than the escape grooves 100 is smaller than a lower limit value within a height tolerance for an application amount by which the liquid gasket 120 is applied. In FIG. 7A, a depth h2 to the bottom portions of the escape grooves 100 is larger than h1.

In this example, the liquid gasket 120 is applied with the gasket applicator 130 to the bottom portion 95 of the groove 90 other than the escape grooves 100. Thus, even when the application amount of the liquid gasket 120 to the groove 90 varies, with the lower limit value within the height tolerance for the application amount of the liquid gasket 120 set to be larger than h1, the liquid gasket 120 is reliably brought into contact with the cartridge receiving portion 81 while being elastically deformed in closing the flange portion 822 of the dispensing pipe 82 with the cartridge receiving portion 81. Thus, the sealing performance with the liquid gasket 120 may be appropriately maintained.

Figure 7B:
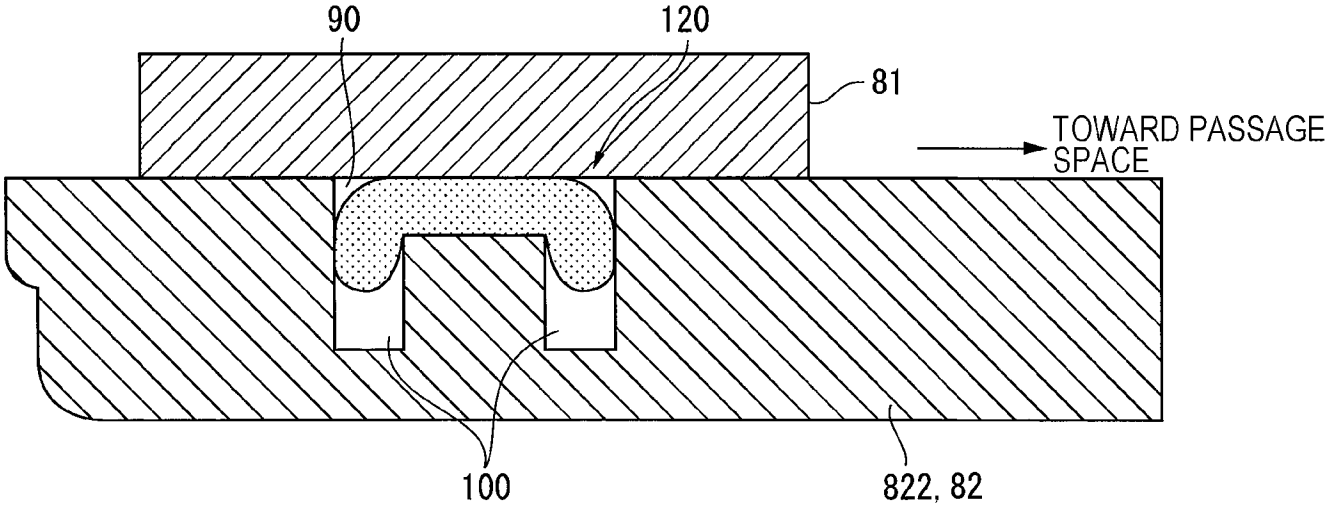

Furthermore, in this example, as illustrated in FIGS. 7A and 7B, a sectional area A in the width direction intersecting the direction in which the groove 90 and the escape grooves 100 extend may be smaller than or equal to an upper limit value within a sectional area tolerance for the application amount of the liquid gasket 120.

In this example, the sectional area A in the width direction of the groove 90 and the escape grooves 100 does not reach the upper limit value within the sectional area tolerance for the application amount of the liquid gasket 120. Thus, even when the application amount of the liquid gasket 120 to the groove 90 varies, in the case where the liquid gasket 120 in the groove 90 is pressed by the cartridge receiving portion 81 serving as a sealing member, as illustrated in FIG. 7B, part of the liquid gasket 120 enters the escape grooves 100 while being elastically deformed. This may suppress spilling of the liquid gasket 120 through a region around the flange portion 822 of the dispensing pipe 82.

In particular, according to the present exemplary embodiment, in the linear portions 92 of the groove 90, the escape grooves 100 are formed in both the portions in the width direction of the groove 90. Thus, the liquid gasket 120 in the groove 90 is elastically deformed and enters the escape grooves 100 positioned in both the portions of the bottom portion 95 at the center in the width direction of the groove 90. This may suppress spilling of the liquid gasket 120 in the groove 90 from both the portions in the width direction. Accordingly, in the present example, the liquid gasket 120 does not necessarily extend toward the passage space through which the toner passes, a possibility of the occurrences of agglomeration of the toner due to contact of an oil component included in the liquid gasket 120 with the toner may be suppressed, and the liquid gasket 120 does not necessarily extend toward the opposite side of the dispensing pipe 82 to the passage space. This may suppress a possibility of damaging the appearance due to spilling of the liquid gasket 120 to a region around the flange portion 822 of the dispensing pipe 82.

Furthermore, in each of the corner portions 91 of the groove 90, only one of the escape grooves 100 is formed in the inner portion in the width direction of the groove 90 (corresponding to a portion of the dispensing pipe 82 near the passage space). However, in the case where the liquid gasket 120 in the groove 90 is pressed by the cartridge receiving portion 81 serving as the sealing member, at least the liquid gasket 120 is elastically deformed and enters the escape groove 100 positioned in the inner portion in the width direction of the groove 90. This may suppress a possibility of the liquid gasket 120 extending toward the passage space of the dispensing pipe 82. Furthermore, since the outer portion (corresponding to a portion of the dispensing pipe 82 near a non-passage space) of the corner portion 91 in the width direction of the groove 90 is formed as the corner angle portion 911, the sectional area of the outer portion of the corner portion 91 of the groove 90 is large than that of the linear portions 92 although the escape groove 100 is not formed on the outer portion of the groove 90. Correspondingly, the liquid gasket 120 is spread and contained in the corner angle portion 911 of the corner portion 91 of the groove 90. This degrades positional accuracy in applying the liquid gasket 120 in the corner portion 91 of the groove 90 due to "redirection". However, a large application target surface for the liquid gasket 120 may be reliably obtained in the corner portion 91. Correspondingly, a possibility of extension of the liquid gasket 120 from the outer portion of the corner portion 91 of the groove 90 in the width direction may be very little.

Furthermore, in this example, the groove 90 has the escape grooves 100 deeply recessed at the bottom portion of the groove 90. Thus, when the flange portion 822 of the dispensing pipe 82 is sealed with the cartridge receiving portion 81 as the sealing member, the liquid gasket 120 enters the deeply recessed escape grooves 100 of the groove 90.

Thus, even if, in order to reopen the connecting portion of the dispensing pipe 82, the retainer 140 between the cartridge receiving portion 81 and the dispensing pipe 82 is removed so as to reopen the connecting opening 821 of the dispensing pipe 82, the liquid gasket 120 remains attracted to the groove 90 and the escape grooves 100 of the dispensing pipe 82 and is held. Thus, even when the cartridge receiving portion 81 is removed from the connecting portion of the dispensing pipe 82, the possibility of the liquid gasket 120 being attracted to the cartridge receiving portion 81 and removed together with the cartridge receiving portion 81 may be suppressed.

Furthermore, according to the present exemplary embodiment, as illustrated in FIG. 6C, in order to apply the liquid gasket 120 to the groove 90 of the flange portion 822 of the dispensing pipe 82, the extension grooves 111, 112 are formed for the corner portion 91*a* of the groove 90, the extension groove 111 is used as the application start point ST for the liquid gasket 120, and the extension groove 112 is used as the application end point ED for the liquid gasket 120. Thus, even when the application amount of the liquid gasket 120 becomes unstable at the start or end of application of the liquid gasket 120, variation in application amount of the liquid gasket 120 does not necessarily affect the inside of the groove 90.

First Comparative Embodiment

Figure 8A:
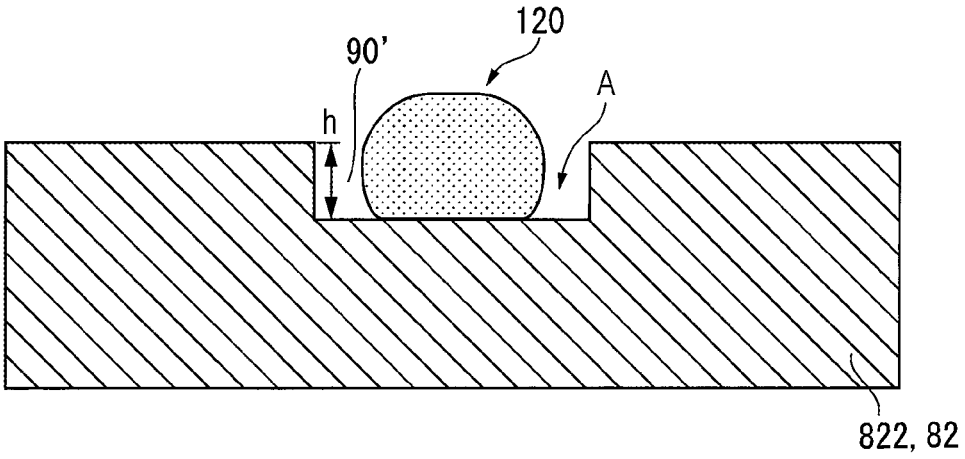
FIG. 8A schematically illustrates a state of the liquid gasket having been applied to the groove around the connecting opening of the dispensing pipe and before sealing in the developer supply device according to a first comparative embodiment, and FIG. 8B schematically illustrates a state of the liquid gasket after sealing.
Figure 8B:
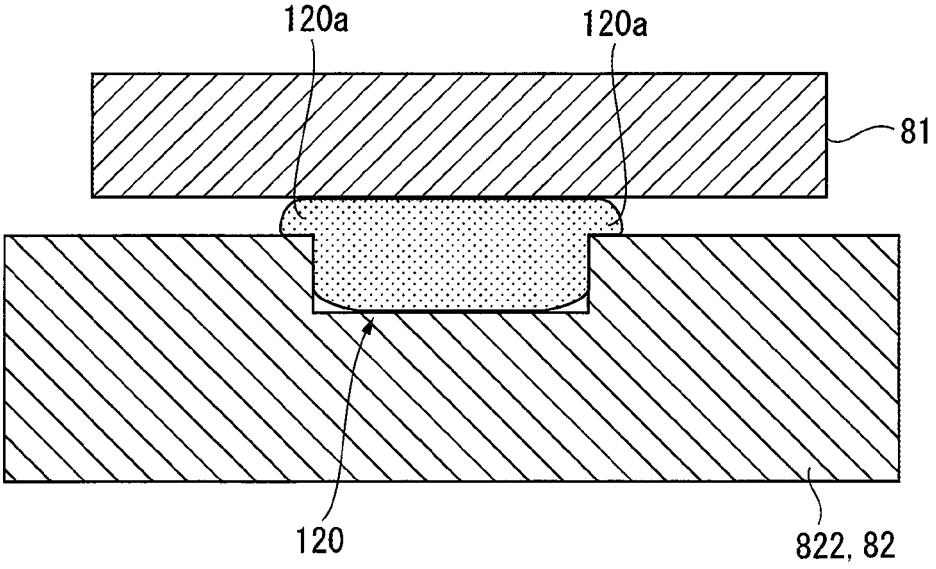

FIGS. 8A and 8B illustrate part of the structure of the connecting portion of the dispensing pipe according to a first comparative example.

Referring to FIGS. 8A and 8B, a groove 90' is provided along the peripheral edge of the connecting opening 821 in the flange portion 822 of the dispensing pipe 82. The liquid gasket 120 is applied to the groove 90'. The groove 90' has, for example, a rectangular shape in section. However, unlike the first exemplary embodiment, escape grooves 100 are not provided in the groove 90'.

According to the present comparative embodiment, in order to maintain the sealing performance of the liquid gasket 120 in an appropriate state, it is required that a depth h of the groove 90' to the bottom portion be smaller than the lower limit value within the height tolerance for the application amount of the liquid gasket 120 and a sectional area A of the groove 90' in the width direction be smaller than or equal to the upper limit value within the sectional area tolerance for the application amount of the liquid gasket 120.

Even with the application amount of the liquid gasket 120 selected as described above, when the application amount of the liquid gasket 120 to the groove 90' varies, as illustrated in FIG. 8B, the liquid gasket 120 may exceed the sectional area A of the groove 90' in the width direction. In such a state, parts 120*a* of the liquid gasket 120 may extend past the groove 90'.

First Variation of the First Exemplary Embodiment

Figure 9A:
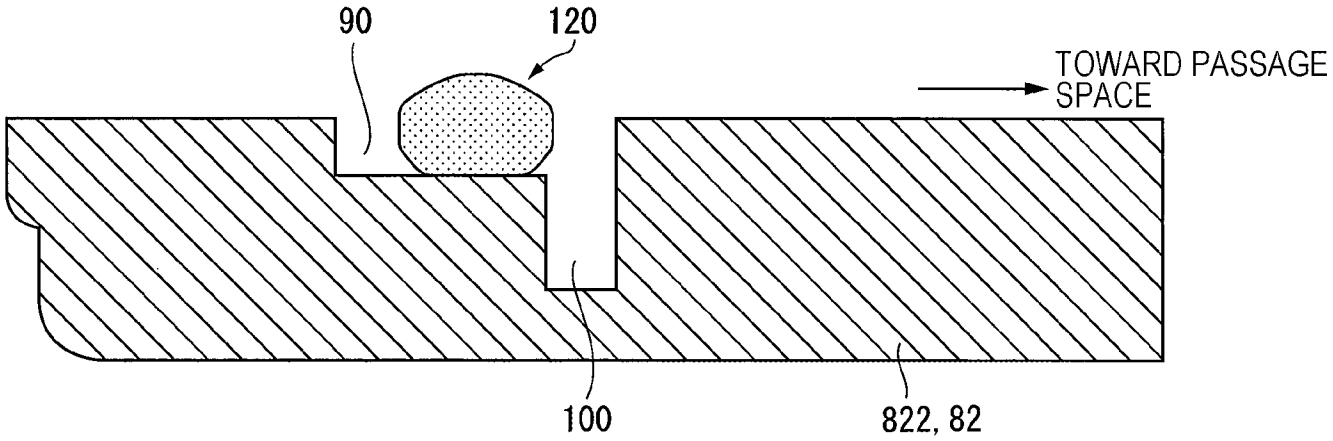
FIG. 9A schematically illustrates a state of the liquid gasket having been applied to the groove around the connecting opening of the dispensing pipe and before sealing in the developer supply device according to a first variation of the first exemplary embodiment, and FIG. 9B schematically illustrates a state of the liquid gasket after sealing.
Figure 9B:
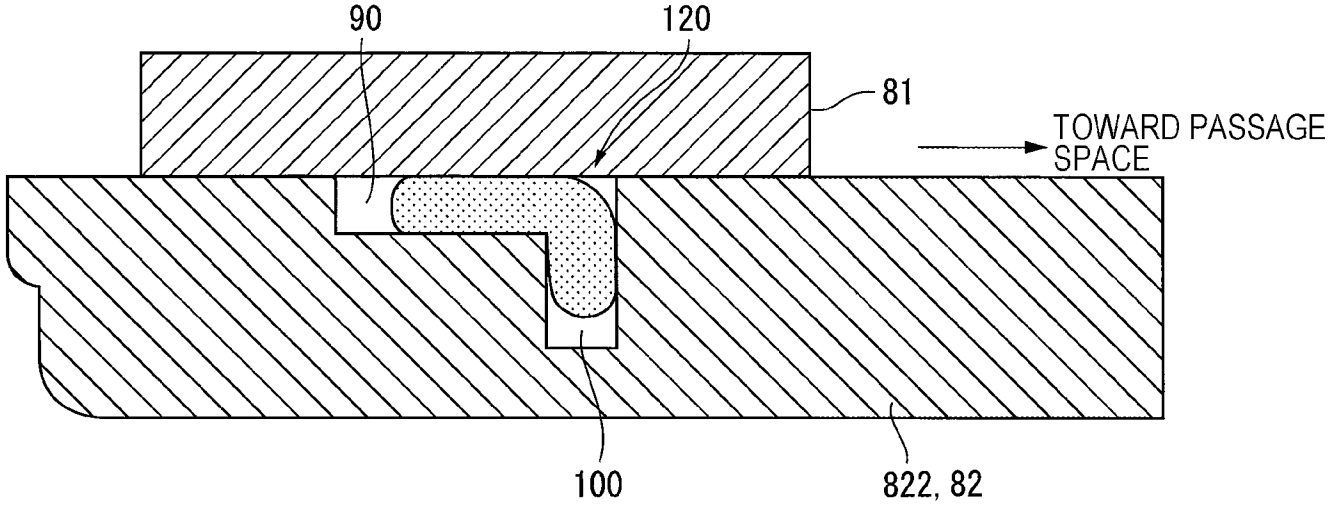

FIGS. 9A and 9B illustrate part of the structure of the connecting portion of the dispensing pipe according to a first variation of the first exemplary embodiment.

Referring to FIGS. 9A and 9B, basically, the structure of the connecting portion of the dispensing pipe 82 is that, similarly to the first exemplary embodiment, the groove 90 is formed in the flange portion 822 of the dispensing pipe 82. However, unlike the first exemplary embodiment, in the corner portions 91 and the linear portions 92 of the groove 90 (see FIG. 5), the escape groove 100 formed by the further deeply recessed deeply recessed groove is formed only in the inner portion in the width direction (corresponding to the portion of the dispensing pipe 82 near the passage space) at the bottom portion of the groove 90.

In this example, the escape groove 100 is formed only in the inner portion in the width direction of the groove 90 (corresponding to the portion of the dispensing pipe 82 near the passage space). However, in the case where the liquid gasket 120 in the groove 90 is pressed by the cartridge receiving portion 81 serving as the sealing member, at least the liquid gasket 120 is elastically deformed and enters the escape groove 100 positioned in the inner portion in the width direction of the groove 90. Thus, extension of the liquid gasket 120 toward the passage space of the dispensing pipe 82 may be suppressed.

In contrast, the escape groove 100 is not formed on the outer portion in the width direction of the groove 90 (corresponding to the portion of the dispensing pipe 82 near the non-passage space). Thus, the liquid gasket 120 in the groove 90 may extend toward the non-passage space of the dispensing pipe 82. Despite this, a situation in which, for example, the liquid gasket 120 is brought into contact with the toner serving as the powder and the toner agglomerates may be suppressed. Even in this example, when it is ensured that the escape groove 100 in the inner portion in the width direction of the groove 90 is large, extension of the liquid gasket 120 through the outer portion of the groove 90 may be effectively suppressed.

Second Variation of the First Exemplary Embodiment

Figure 10A:
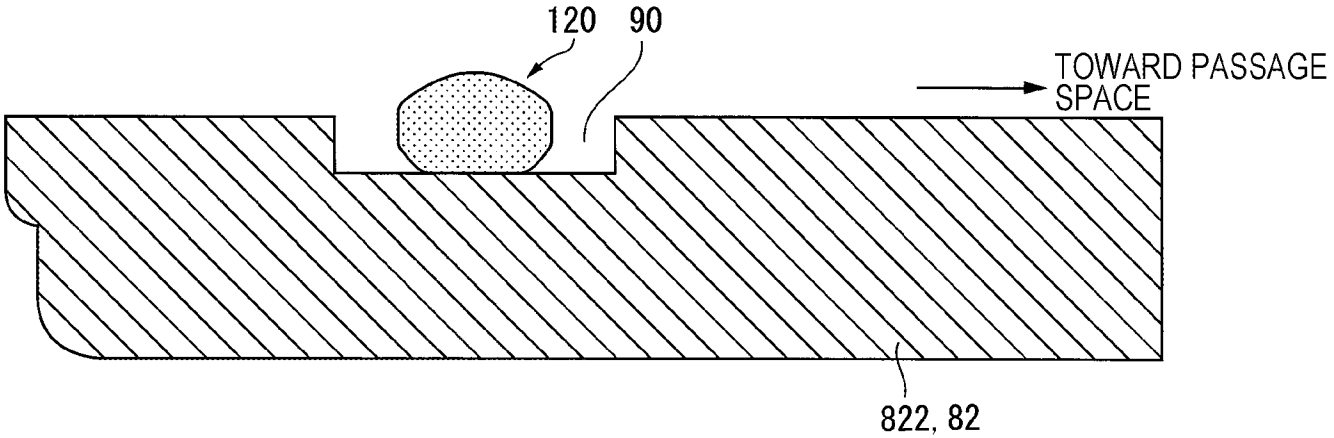
FIG. 10A schematically illustrates a state of the liquid gasket having been applied to the groove around the connecting opening of the dispensing pipe and before sealing in the developer supply device according to a second variation of the first exemplary embodiment, and FIG. 10B schematically illustrates a state of the liquid gasket after sealing.
Figure 10B:
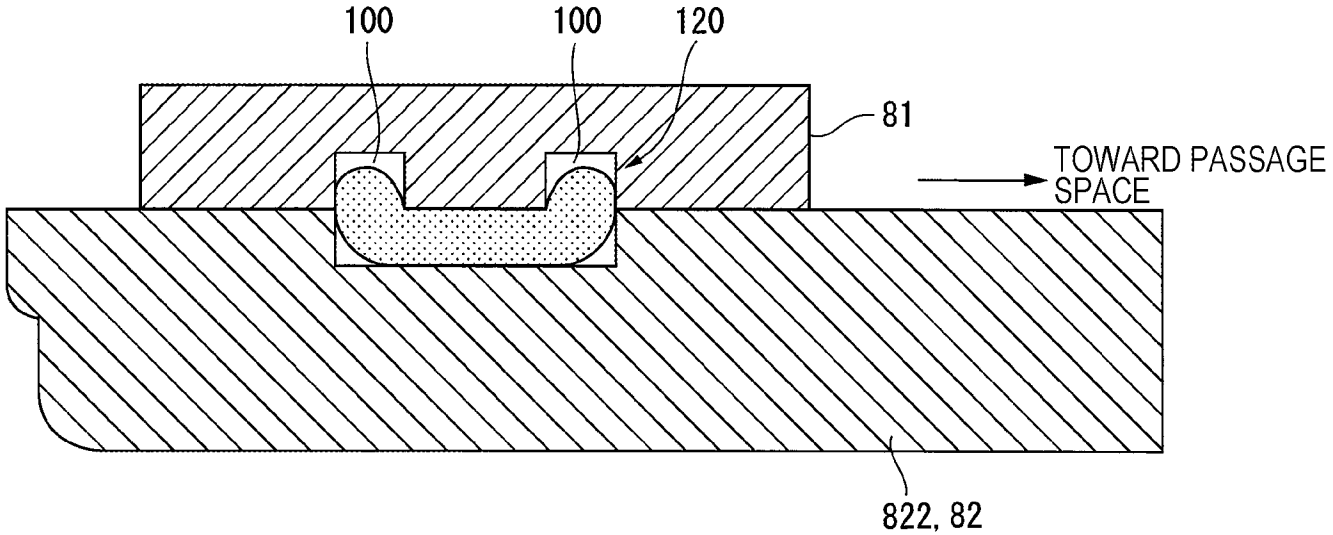

FIGS. 10A and 10B illustrate part of the structure of the connecting portion of the dispensing pipe according to a second variation of the first exemplary embodiment.

Referring to FIGS. 10A and 10B, basically, the structure of the connecting portion of the dispensing pipe 82 is that, similarly to the first exemplary embodiment, the groove 90 is formed in the flange portion 822 of the dispensing pipe 82. However, unlike the first exemplary embodiment, the escape grooves 100 are formed along the peripheral edge of the supply opening (corresponding to the connecting opening) 811 of the cartridge receiving portion 81 facing the groove 90.

In this example, a pair of the escape grooves 100 are formed in both portions in the width direction of the groove 90 so as to face the opening of the groove 90.

Accordingly, in this example, when the flange portion 822 of the dispensing pipe 82 is sealed with the cartridge receiving portion 81 serving as the sealing member after the liquid gasket 120 has been applied to the groove 90 of the flange portion 822 of the dispensing pipe 82 as illustrated in FIG. 10A, part of the liquid gasket 120 in the groove 90 is elastically deformed and enters the escape grooves 100 of the cartridge receiving portion 81. This may suppress extension of the liquid gasket 120 in the groove 90 from both the portions in the width direction of the groove 90.

Although the escape grooves 100 are provided in both the portions in the width direction of the groove 90 in this example, this is not limiting. For example, the escape groove 100 may be provided so as to correspond to only the inner portion in the width direction of the groove 90 (corresponding to the portion of the dispensing pipe 82 near the passage space).

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder passage component comprising:

a first passage defining unit that has at least a first connecting opening which is formed at a part thereof and which has a first peripheral edge and that defines a passage space which allows powder to pass therethrough;

a second passage defining unit that has a second connecting opening having a second peripheral edge, that is connected to the first connecting opening of the first passage defining unit at the second connecting opening, and that defines a passage space which allows the powder to pass therethrough; and a sealing section that seals the first peripheral edge and the second peripheral edge, wherein the sealing section includes a liquid gasket, wherein the sealing section has a groove that has a bottom portion and a side facing the corresponding passage space and that is formed along one of the first peripheral edge and the second peripheral edge, wherein the liquid gasket is applied to an inside of the groove and elastically deformed so as to be brought into contact with another of the first peripheral edge and the second peripheral edge facing the groove, and wherein the sealing section has at least one escape groove that is provided at the bottom portion of the groove or along the other of the first peripheral edge and the second peripheral edge facing the groove and that allows a part of an elastically deformed portion of the liquid gasket to escape so as not to allow the liquid gasket to extend past at least the side of the groove facing the corresponding passage space.

2. The powder passage component according to claim 1, wherein a depth of the groove to the bottom portion other than the at least one escape groove is smaller than a lower limit value within a height tolerance for an amount by which the liquid gasket is applied.

3. The powder passage component according to claim 1, wherein a sectional area in a width direction intersecting a direction in which the groove and the at least one escape groove extend is smaller than or equal to an upper limit value within a sectional area tolerance for an amount by which the liquid gasket is applied.

4. The powder passage component according to claim 1, wherein the at least one escape groove is a deeply recessed groove forming, together with the bottom portion of the groove, a stepped shape.

5. The powder passage component according to claim 1, wherein the at least one escape groove is formed at least in a portion facing the corresponding passage space in a width direction intersecting a direction in which the groove extends.

6. The powder passage component according to claim 1, wherein the at least one escape groove includes a plurality of escape grooves, and wherein the plurality of escape grooves are formed in both portions in a width direction intersecting a direction in which the groove extends.

7. The powder passage component according to claim 1, wherein the at least one escape groove includes a plurality of escape grooves, wherein one of the first connecting opening and the second connecting opening having the one of the first peripheral edge and the second peripheral edge has a corner portion and a linear portion other than the corner portion, wherein, in a portion along the linear portion, the plurality of escape grooves are formed in both portions in a width direction intersecting a direction in which the groove extends, and wherein, in a portion corresponding to the corner portion, one of the plurality of escape grooves in an inner portion in the width direction is formed.

8. The powder passage component according to claim 1, wherein the groove is formed along the one of the first peripheral edge or the second peripheral edge, wherein one of the first connecting opening and the second connecting opening having the one of the first peripheral edge and the second peripheral edge has a corner portion, wherein an extension groove outwardly extending from the groove is added to a portion of the groove corresponding to the corner portion, and the extension groove is used as a start point and an end point for applying the liquid gasket.

9. A powder processing apparatus comprising:

the powder passage component according to claim 1, wherein processing is performed by using the powder passing through the powder passage component.

10. A powder passage component comprising:

first means for defining a passage that has at least a first connecting opening which is formed at a part thereof and which has a first peripheral edge and that defines a passage space which allows powder to pass therethrough;

second means for defining a passage that has a second connecting opening having a second peripheral edge, that is connected to the first connecting opening of the first means for defining a passage at the second connecting opening, and that defines a passage space which allows the powder to pass therethrough; and means for sealing that seals the first peripheral edge and the second peripheral edge, wherein the means for sealing includes a liquid gasket, wherein the means for sealing has a groove that has a bottom portion and a side facing the corresponding passage space and that is formed along one of the first peripheral edge and the second peripheral edge, wherein the liquid gasket is applied to an inside of the groove and elastically deformed so as to be brought into contact with another of the first peripheral edge and the second peripheral edge facing the groove, and wherein the means for sealing has at least one escape groove that is provided at the bottom portion of the groove or along the other of the first peripheral edge and the second peripheral edge facing the groove and that allows a part of an elastically deformed portion of the liquid gasket to escape so as not to allow the liquid gasket to extend past at least the side of the groove facing the corresponding passage space.

* * * * *